US010913692B1

(12) United States Patent
LaBonte et al.

(10) Patent No.: US 10,913,692 B1
(45) Date of Patent: Feb. 9, 2021

(54) EXTREMELY SLOW PYROTECHNIC STROBE COMPOSITION WITH REDUCED TOXICITY

(71) Applicant: U.S. Army Combat Capabilities Development Command, Chemical Biological Center, APG, MD (US)

(72) Inventors: Amee W LaBonte, Havre de Grace, MD (US); Michael F Kauzlarich, Edgewood, MD (US)

(73) Assignee: America as Represented by the Secretary of the Army, Washington, DC (US)

( * ) Notice: Subject to any disclaimer, the term of this patent is extended or adjusted under 35 U.S.C. 154(b) by 69 days.

(21) Appl. No.: 16/273,942

(22) Filed: Feb. 12, 2019

Related U.S. Application Data

(62) Division of application No. 14/645,656, filed on Mar. 12, 2015, now Pat. No. 10,207,959.

(51) Int. Cl.
*C08B 33/08* (2006.01)
*C06B 33/08* (2006.01)

(52) U.S. Cl.
CPC ..... *C06B 33/08* (2013.01)

(58) Field of Classification Search
CPC ..... C06B 33/08
See application file for complete search history.

(56) References Cited

U.S. PATENT DOCUMENTS 7,578,895 B1 * 8/2009 Chen ..... C06B 33/04 149/37
2010/0276042 A1 * 11/2010 Ashcroft ..... C06B 21/005 149/19.3
2013/0299194 A1 * 11/2013 Bell ..... F42B 1/028 166/382

* cited by examiner

*Primary Examiner* — Aileen B Felton
(74) *Attorney, Agent, or Firm* — Ulysses John Biffoni

(57) ABSTRACT

A reduced toxicity pyrotechnic strobe composition and method includes creating a mixture of strontium nitrate, magnalium, sulfur, and no more than 10 parts by weight of a nitrocellulose binder. The strontium nitrate may comprise 27 percent of the mixture. The magnalium may comprise a 50:50 blend of magnesium and aluminum. The magnalium may comprise 18 percent of the mixture. The sulfur may comprise 55 percent of the mixture. The mixture may include a pulse rate of approximately one pulse per minute. The method may further include modifying the pulse rate of the mixture. The method may further include using a reduced particle size of the magnalium. The method may further include substituting no more than 12.5% of the strontium nitrate with potassium nitrate.

7 Claims, 2 Drawing Sheets

EXTREMELY SLOW PYROTECHNIC STROBE COMPOSITION WITH REDUCED TOXICITY

CROSS-REFERENCE TO RELATED APPLICATIONS

This application is a divisional of U.S. application Ser. No. 14/645,656 filed on Mar. 12, 2015, now U.S. Pat. No. 10,207,959 which is commonly assigned.

GOVERNMENT INTEREST

The embodiments described herein may be manufactured, used, and/or licensed by or for the United States Government.

BACKGROUND

Technical Field

The embodiments herein generally relate to pyrotechnic strobe compositions, and more particularly to an extremely slow pyrotechnic strobe composition of reduced toxicity.

Description of the Related Art

The most common pyrotechnic strobe composition is a blend of magnesium, ammonium perchlorate, potassium sulfate, potassium dichromate, and a binder. It is an effective strobe composition, producing very distinct dark and light phases. The burning characteristics of the fuel/oxidizer mixture cause the formation of a "crust" on the surface layer of the strobe. The addition of sulfate enhances the burning characteristic of the mixture, assisting in the formation of a strong "crust" layer, thus defining the intensity of the strobe effect. Strobe mixtures producing approximately one pulse per second are difficult to reproduce with the conventional compositions because the chemical reaction in the conventional mixtures proceed much faster than that of the slow strobe and generally cannot appreciably be slowed down to match the reaction rate of the slow strobe. Moreover, while the conventional mixture reaction rates can be varied somewhat, it is limited by the kinetics of the reaction and the nature of the reactants. Typically what happens when attempting to vary the reaction rates in the conventional mixtures is that the mixtures form the aforementioned crust layer (dark reaction) and heat; pressure build up under the crust. Once it reaches a certain point it flashes (light reaction). In the conventional formulations, the potassium dichromate (a highly toxic material to both humans and the environment) is used to coat the magnesium particles to prevent degradation prior to reaction. Other strobe formulations exist without the environmentally unfriendly perchlorate oxidizer. Unfortunately, these mixtures employ barium nitrate, which may be less harmful to the environment, but is toxic to humans.

SUMMARY

In view of the foregoing, an embodiment herein provides a reduced toxicity pyrotechnic strobe composition comprising a mixture of strontium nitrate, magnalium, sulfur, and a nitrocellulose binder. The strontium nitrate may comprise 27 percent of the mixture. The magnalium may comprise a 50:50 blend of magnesium and aluminum. The magnalium may comprise 18 percent of the mixture. The sulfur may comprise 55 percent of the mixture. The mixture may comprise a pulse rate of approximately one pulse per minute. The mixture may comprise potassium nitrate.

Another embodiment provides a method of making a reduced toxicity pyrotechnic strobe composition, the method comprising creating a mixture of strontium nitrate, magnalium, sulfur, and a nitrocellulose binder. The strontium nitrate may comprise 27 percent of the mixture. The magnalium may comprise a 50:50 blend of magnesium and aluminum. The magnalium may comprise 18 percent of the mixture. The sulfur may comprise 55 percent of the mixture. The mixture may comprise a pulse rate of approximately one pulse per minute. The method may further comprise modifying a pulse rate of the mixture. The method may further comprise using a reduced particle size of the magnalium, wherein the particle size of the magnalium is in the range of 50-325 mesh. The method may further comprise substituting no more than 12.5% of the strontium nitrate with potassium nitrate. The method may further comprise inserting the mixture at loading pressures between 2,500 and 7,500 pounds per square inch into a canister. The method may further comprise inserting the composition into any of a canister of a flare, a grenade, a smoke pot, a mortar round, and an artillery round.

Another embodiment provides a method of making a reduced toxicity pyrotechnic strobe composition, the method comprising creating a mixture comprising 27 percent strontium nitrate, 18 percent magnalium comprising a 50:50 blend of magnesium and aluminum, 55 percent sulfur, and no more than 10 parts by weight of a nitrocellulose binder. The method may further comprise modifying a pulse rate of the mixture.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
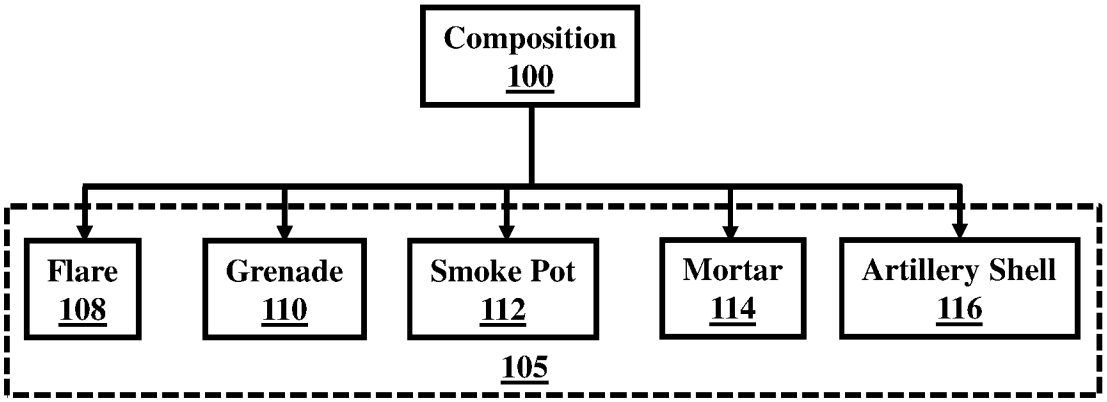
FIG. 1 is a block diagram of using extremely slow pyrotechnic strobe composition according to an embodiment herein.
Figure 2:
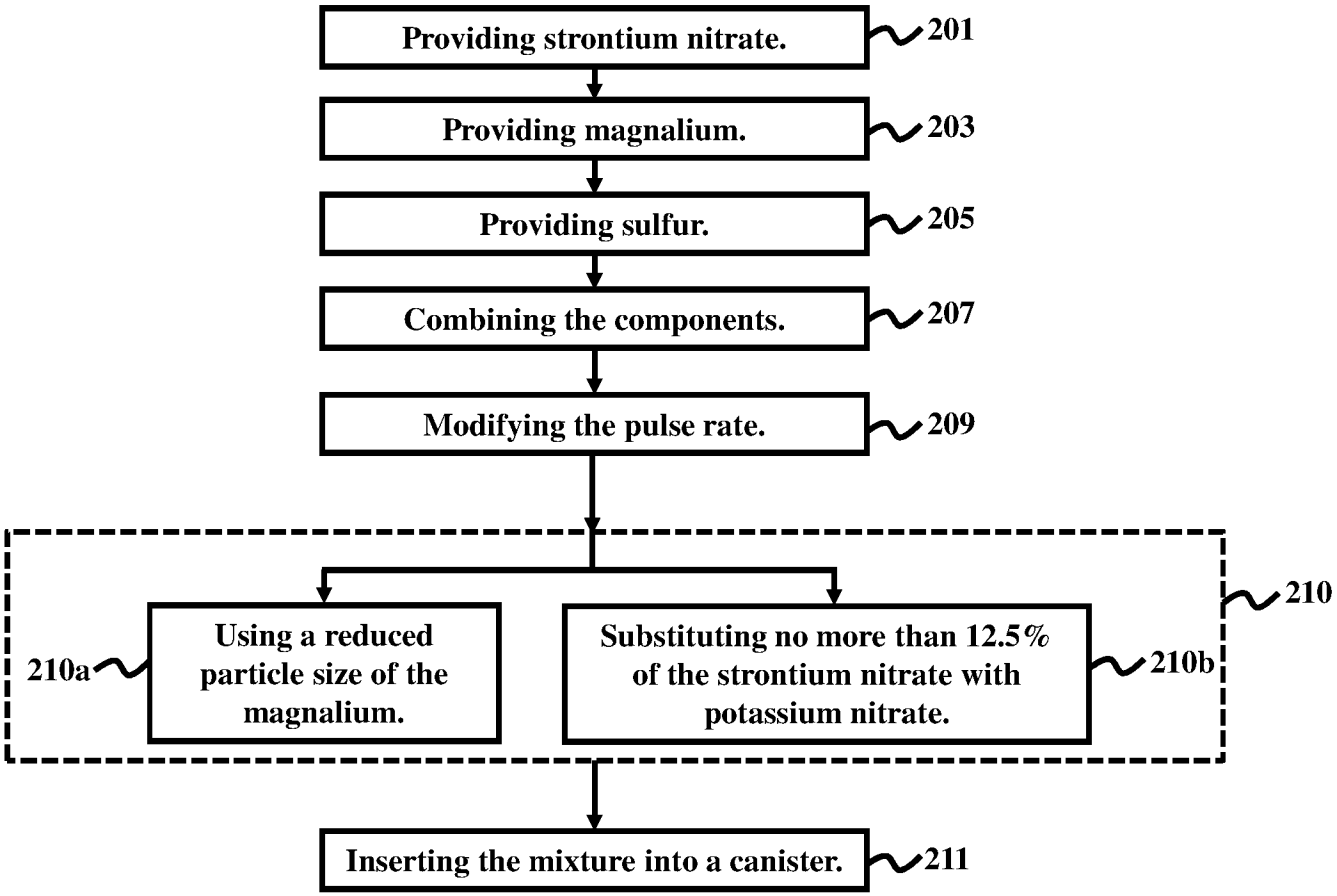
FIG. 2 is a flow diagram illustrating a method according to an embodiment herein.

The embodiments herein provide an extremely slow pyrotechnic strobe composition of reduced toxicity while producing as bright a strobe flash as traditional strobe compositions. The composition can be produced without the use of organic liquids which add to air pollution, and contain specific chemicals to increase its long term shelf life. Referring now to the drawings, and more particularly to FIGS. 1 through 2, where similar reference characters denote corresponding features consistently throughout the figures, there are shown preferred embodiments.

The embodiments herein provide a strobe composition 100 which utilizes strontium nitrate as the oxidizer, and magnalium and sulfur as the fuels of the composition 100. This formulation uses no perchlorates, dichromates, or barium compounds and is thus less toxic and more environmentally friendly than conventional strobe formulations.

The chemical reaction for the production of the slow strobe composition 100 includes a three component system with a set of two competing reactions. In one reaction, the magnesium in the magnalium powder reacts with the sulfur to form magnesium sulfide. In the second reaction, the strontium nitrate and aluminium react to produce strontium oxide, nitrogen gas, and aluminium oxide. The composition 100 is completely devoid of the toxic perchlorates, dichromates, and barium compounds found in conventional strobe formulations. The particle size of the metal powder can be varied in such a manner as to adjust the overall rate of the chemical reaction, and thus act as a pulse rate modifier, which comprises the number of pulses per minute for a pressed block of strobe composition 100. In this regard, the composition demonstrates an extremely uncharacteristic pulse rate of approximately one pulse per minute, as opposed to the standard approximately five pulses per second found with conventional solutions. The embodiments herein further allow for the use of the reduced toxicity slow strobe composition 100 in flares 108, flash/bang grenades 110, smoke pots 112, mortars 114, and artillery shells 116.

FIG. 1 is a block diagram illustrating utilizing the reduced toxicity slow strobe composition 100 in canisters 105, which can be implemented in flares 108, hand grenades 110, smoke pots 112, mortars 114, and artillery shells 116. The reduced toxicity slow strobe composition 100 has an application in any pressed configuration. When pressed at a loading pressure of 1,000 pounds per square inch into a suitable sized canister 105, the base composition 100 can provide a strobing flare/grenade two orders of magnitude slower than conventional flares. Furthermore, when pressed into larger canisters 105 suitable for use in a mortar 114 or artillery shell 116, the composition 100 is pressed at a suitable loading pressure that exceeds the setback force on the canister 105 during the flight to the target area (not shown). The base composition 100 produces very slow strobes at a pressure of 5,000 psi.

FIG. 2, with reference to FIG. 1, is a flow diagram illustrating a method of making a reduced toxicity pyrotechnic strobe composition 100, the method comprising creating a mixture by combining various components including providing (201) strontium nitrate, providing (203) magnalium, providing (205) sulfur, and combining (207) the components to create the composition 100, wherein the combining (207) step includes adding a nitrocellulose binder to the mixture. The strontium nitrate preferably comprises 27 percent of the mixture. The magnalium preferably comprises a 50:50 blend of magnesium and aluminum. The magnalium preferably comprises 18 percent of the mixture. The sulfur preferably comprises 55 percent of the mixture. The nitrocellulose binder preferably comprises no more than 10 parts by weight additional to the mixture. The mixture preferably comprises a pulse rate of approximately one pulse per minute. The method may further comprise modifying (209) a pulse rate of the mixture. This can occur using various techniques (210) including using (210*a*) a reduced particle size of the magnalium, or substituting (210*h*) no more than 12.5% of the strontium nitrate with potassium nitrate.

With respect to using (210*a*) a reduced particle size of the magnalium, the embodiments herein use a particle size of approximately 50-325 mesh for the magnalium. The smaller the particle size (e.g., the larger the mesh size), the faster the pulses. However, the smaller/finer the particle size, the messier it becomes to work with, and the more it becomes an inhalation irritant. Therefore, the embodiments herein utilize a non-conventional mesh size for magnalium. Substituting (210*b*) the strontium nitrate with potassium nitrate allows for a faster strobe (e.g., approximately seven flashes per minute), however substituting more than 12.5% of the strontium nitrate with potassium nitrate causes the mixture to become a flare. The method may further comprise inserting (211) the mixture at loading pressures between 2,500 and 7,500 pounds per square inch into a canister 105. The method may further comprise inserting the composition 100 into any of a canister 105 of a flare 108, a grenade 110, a smoke pot 112, a mortar round 114, and an artillery round 116.

The slow strobe producing composition 100 may be consolidated at loading pressures between 2,500 and 5,000 pounds per square inch into a canister 105 of flare/flash grenade size configured approximately 2.3 inches in diameter and between approximately 4.5 and 6.0 inches in height. Moreover, the composition 100 may be consolidated at loading pressures between 2,500 and 5,000 pounds per square inch into a canister 105 of smoke pot size configured approximately 6 inches in diameter and nominally 8 inches in height to approximately 12 inches in diameter and nominally 13 inches in height. Furthermore, the composition 100 may be consolidated at loading pressures between 2,500 and 5,000 pounds per square inch into a single or multiple canisters 105 totaling approximately 2.75 inches in diameter and between approximately 7.5 and 9.0 inches in height for use in an 81 mm or similar mortar payload configuration. Additionally, the composition 100 may be consolidated at loading pressures between 5,000 and 7,500 pounds per square inch into a single or multiple canisters 105 of smoke artillery size configured totaling approximately 5 inches in diameter and nominally 21 inches in height for use in a 155 min projectile.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A method of making a reduced toxicity pyrotechnic strobe composition, said method comprising creating a mixture consisting essentially of about 27 percent strontium nitrate, about 18 percent magnalium, about 55 percent sulfur, and a nitrocellulose binder.

2. The method of claim 1, wherein said magnalium comprises about a 50:50 blend of magnesium and aluminum.

3. The method of claim 1, wherein said mixture produces a pulse rate of approximately one pulse per minute.

4. The method of claim 1, wherein said method further comprises substituting no more than 12.5% of said strontium nitrate with potassium nitrate.

5. The method of claim 1, wherein a particle size of said magnalium is in the range of 50-325 mesh.

6. The method of claim 1, further comprising inserting said mixture at loading pressures between 2,500 and 7,500 pounds per square inch into a canister.

7. The method of claim 1, further comprising inserting the composition into any of a canister of a flare, a grenade, a smoke pot, a mortar round, and an artillery round.

* * * * *